US010441062B2

(12) United States Patent
Smith, Jr.

(10) Patent No.: US 10,441,062 B2
(45) Date of Patent: Oct. 15, 2019

(54) INTEGRAL JACKET BACKPACK ASSEMBLY

(71) Applicant: Al J Smith Enterprise, LLC, Pittsburgh, PA (US)

(72) Inventor: Al J Smith, Jr., Pittsburgh, PA (US)

( * ) Notice: Subject to any disclaimer, the term of this patent is extended or adjusted under 35 U.S.C. 154(b) by 0 days.

(21) Appl. No.: 15/420,130

(22) Filed: Jan. 31, 2017

(65) Prior Publication Data

US 2017/0215558 A1 Aug. 3, 2017

Related U.S. Application Data

(60) Provisional application No. 62/289,575, filed on Feb. 1, 2016.

(51) Int. Cl.

| | |
|---|---|
| ***A45F 4/00*** | (2006.01) |
| ***A45F 4/12*** | (2006.01) |
| ***A41D 3/00*** | (2006.01) |

(52) U.S. Cl.

CPC ..... *A45F 4/12* (2013.01); *A41D 3/00* (2013.01); *A41D 2400/422* (2013.01); *A41D 2400/48* (2013.01)

(58) Field of Classification Search

CPC ... A45F 4/12; A45F 3/04; A45F 3/042; A41D 3/00; A41D 2400/422; A41D 2400/48; A41D 3/04

See application file for complete search history.

(56) References Cited

U.S. PATENT DOCUMENTS

| | | | | | |
|---|---|---|---|---|---|
| 2,016,897 | A | * | 10/1935 | Garrett | A41D 13/02 2/227 |
| 4,307,470 | A | | 12/1981 | Ezell | |
| 4,563,777 | A | * | 1/1986 | Park | A41D 15/04 2/108 |
| 4,689,831 | A | * | 9/1987 | Greenberger | A45F 4/12 2/108 |
| 5,123,117 | A | * | 6/1992 | Prendergast | A45F 4/12 2/108 |
| 5,165,111 | A | | 11/1992 | Lieberman | |
| 5,407,112 | A | * | 4/1995 | Christodoulou | A41D 15/04 2/94 |
| 5,526,969 | A | | 6/1996 | Greenberger | |
| 5,699,560 | A | * | 12/1997 | Greenberg | A41D 3/00 2/108 |
| D404,539 | S | | 1/1999 | Glasser | |
| 6,134,712 | A | * | 10/2000 | Spector | A41D 15/04 2/94 |
| 6,315,178 | B1 | | 11/2001 | Nobata | |
| 6,393,613 | B1 | | 5/2002 | Sheu | |
| 6,421,834 | B2 | | 6/2002 | Kester | |
| D538,008 | S | * | 3/2007 | Helbing | D2/743 |

(Continued)

*Primary Examiner* — Corey N Skurdal

(74) *Attorney, Agent, or Firm* — Thomas M. Joseph, Esq.

(57) ABSTRACT

An integral jacket backpack assembly includes a jacket for draping over a wearer. The jacket has an outer surface with a front section covering the front of the wearer and back section covering the back of the wearer. The backpack has a front surface and a back surface with the front surface abutting the jacket outer surface back section when the jacket is draped over a wearer. The center of the backpack front surface connects to the center of the jacket outer surface back section to connect the jacket to the backpack.

20 Claims, 5 Drawing Sheets

(56) References Cited

U.S. PATENT DOCUMENTS

| | | | | |
|---|---|---|---|---|
| 7,363,659 | B1 * | 4/2008 | Colbert | A41D 3/00 2/86 |
| 7,374,071 | B2 * | 5/2008 | Lavelle | A41D 3/08 2/94 |

* cited by examiner

INTEGRAL JACKET BACKPACK ASSEMBLY

CROSS REFERENCE TO RELATED APPLICATION

This application claims the benefit under 35 U.S.C. § 119(e) of U.S. Provisional Application No. 62/289,575 entitled "INTEGRAL JACKET BACKPACK ASSEMBLY" filed Feb. 2, 2016, which is incorporated herein by reference.

BACKGROUND

A backpack, sometimes referred to as a knapsack, is a pouch or bag that, typically, is provided with shoulder straps. The shoulder straps can form loops for supporting the pouch or bag on the back of a wearer. While backpacks were originally intended for use by soldiers and hikers, they are very popular with the general public for everyday use. Backpacks are especially popular with children who attend schools or daycare facilities.

Many children use backpacks to store books, school supplies, their lunch, extra clothing, or other similar items. Indeed, children are more likely to carry books and other articles in a backpack, as opposed to in a briefcase or in other hand-carried bags or pouches, because backpacks leave their hands free.

Children, as well as adults, often need jackets, coats or other similar outerwear when the weather is inclement. In such instances, it is common practice for children or adults to take along a jacket or a coat of a type that can be easily folded. The folded jackets and/or coats can be stored in the bag of the backpack, which frees the hands of the wearer.

While the typical backpack will include a pouch or a pack that is sufficiently large to store folded coats or jackets, the storage of the coat or the jacket in that manner will reduce the amount of space available for books and other articles to be carried in the backpack. The backpack can become difficult to carry and/or to support when the backpack is heavily loaded.

Other problems occur when children bring backpacks and jackets to schools, to pre-schools, and to daycare facilities. Specifically, the backpacks and/or the jackets can be lost when they are stored in separate rooms, particularly if the children, the teachers or other assistants are not paying attention as to which jacket and/or backpack goes with which child. This problem can arise even when the jackets and the backpacks are stored in the same room, together, because the jackets and the backpacks are separate, disconnected items.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, an integral jacket backpack assembly includes a jacket for draping over a wearer. The jacket has an outer surface with a front section covering the front of the wearer and back section covering the back of the wearer. The backpack has a front surface and a back surface with the front surface abutting the jacket outer surface back section when the jacket is draped over a wearer. The center of the backpack front surface connects to the center of the jacket outer surface back section to connect the jacket to the backpack.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more aspects of the described subject matter. It is to be appreciated, however, that such aspects can be practiced without these specific details.

Various aspects of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Figure 1:
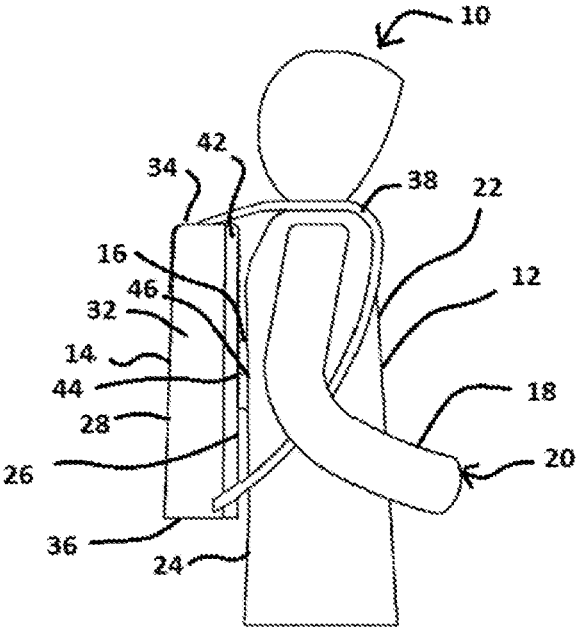
FIG. 1 illustrates a side view of a preferred embodiment of an integral jacket backpack assembly that can implement aspects of the described subject matter.

FIG. 1 illustrates an integral jacket backpack assembly 10 that includes a jacket 12 that is in an unfolded configuration and is suitable for draping over a wearer (not shown). The integral jacket backpack assembly 10 includes a backpack 14 that connects to the jacket 12 with a permanent connector 16. The jacket 12 can be folded into a folded configuration and stored in the backpack 12 for later use by the wearer.

The jacket 12 includes an outer surface 18 and an inner surface 20 with the inner surface 20 contacting the wearer, at least partially. The outer surface 18 includes a front section 22 that covers the front of the torso of the wearer when the jacket 12 is draped over the wearer. The outer surface 18 includes a back section 24 that covers the back of the wearer when the jacket 12 is draped over the wearer. Optionally, the jacket 12 can include one or more pockets and/or tags.

The backpack 14 includes a front surface 26, a back surface 28, a pair of side surfaces 30-32, a top surface 34, and a bottom surface 36. The front surface 26 abuts the jacket outer surface back section 24 when the jacket 12 is draped over a wearer to form an interface that is shared by the jacket 12 and the backpack 14. The jacket 12 connects to the backpack 14, essentially, at the center of this interface.

The backpack 14 includes a pair of essentially vertically aligned shoulder straps 38-40 that are in a spaced-apart relationship with one another. The shoulder straps 38-40 have ends that connect to top surface 34 and side surfaces 30-32. The shoulder straps 38-40 allow the wearer to support the backpack 14 in the folded configuration and in the unfolded configuration. It should be understood that the shoulder straps 38-40 can be aligned in other configurations, such as configurations that included crossed straps. The shoulder straps 38-40 can include fasteners, such as D-rings, to facilitate attachment of the ends to the top surfaces 34 and the side surfaces 38-40.

The backpack 14 includes a pouch 42 for storing the jacket 12. In this exemplary embodiment, the dimensions of the pouch 42 can be selected to allow for storage of only the jacket 12 or to allow for the storage of additional items with the jacket 12. It should be understood the pouch 42 can be porous to facilitate the drying of the jacket 12 after it has been used in wet conditions.

The permanent connector 16 that connects the jacket 12 to the backpack 14 can be solid, tubular, or hollow. The permanent connector 16 is formed by connecting the backpack front surface 26 to the jacket outer surface back section 24. The permanent connector 16 is formed by stitching a center portion 44 of backpack front surface 26 to a center portion 46 of the jacket outer surface back section 24.

The center portion 44 can be located at, essentially, a predetermined location that corresponds to the geometric center of the backpack front surface 26 or at, essentially, a predetermined location that corresponds to the center of mass of a loaded, partially loaded, or unloaded backpack 14 that is projected onto the backpack front surface 26.

The center portion 46 can be located at, essentially, a predetermined location that corresponds to the geometric center of the jacket outer surface back section 24 or at, essentially, a predetermined location that corresponds to the center of mass of the torso of a wearer that had been projected onto the jacket outer surface back section 24.

Figure 2:
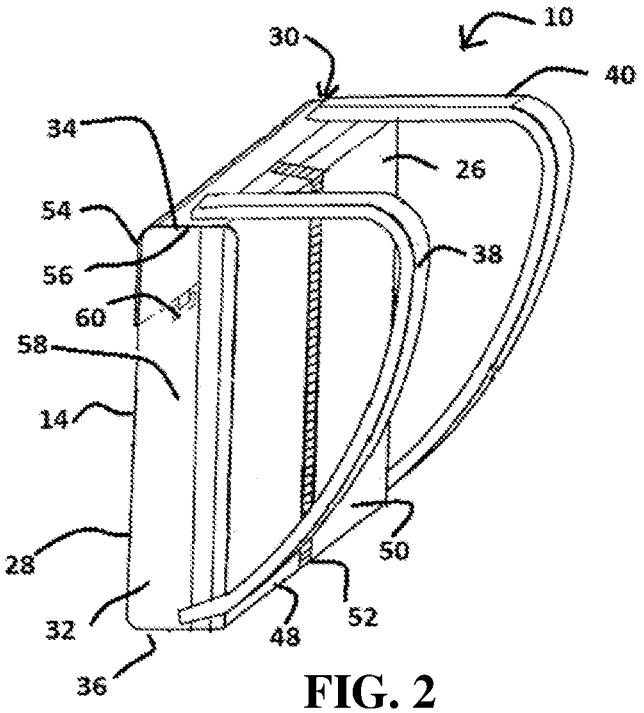
FIG. 2 illustrates a perspective view of a preferred embodiment of an integral jacket backpack assembly that can implement aspects of the described subject matter.

Referring to FIG. 2 with continuing reference to the foregoing figures, the integral jacket backpack assembly 10 includes the jacket 12 in the folded configuration. In the folded configuration, the jacket 12 can be placed within the backpack 14 and contained within the pouch 42. The pouch 42 is formed from two side flaps 48-50. The side flaps 48-50 connect to one another with a vertically aligned zipper 52. Preferably, the clasp portion of the zipper 52 moves in an upward direction to close the pouch 42 and in a downward direction to open the pouch 42.

The side flaps 48-50 can be made from a solid material or from mesh materials. The side flaps 48-50 can be permanently connected or integral with the backpack 14 or can be removably connected to the backpack 14 by using semi-permanent or temporary fasteners. Preferably, the side flaps 48-50 are made from a mesh material to form a porous pouch 42 to facilitate storage of the jacket 12 when it is wet. The side flaps 48-50 can be panels.

The backpack 14 includes a lid 54 that covers an opening 56. The opening 56 communicates with a chamber 58 to form a compartment for storing school supplies, books, or other items. The lid 54 includes a clasp 60 to secure the lid 54 when the lid 54 is covering the opening 56 to close the chamber 58.

Figure 3:
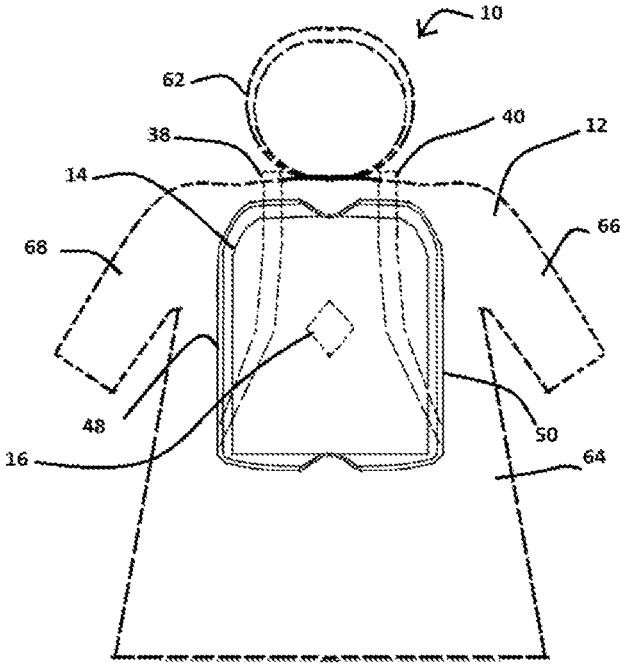
FIG. 3 illustrates a front view of an preferred embodiment of an integral jacket backpack assembly showing the jacket portion and shoulder straps in phantom that can implement aspects of the described subject matter.
Figure 4:
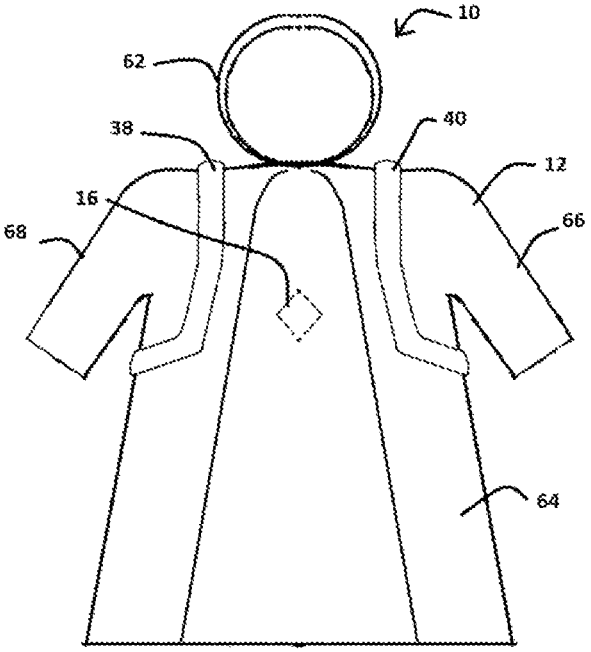
FIG. 4 illustrates a front view of a preferred embodiment of an integral jacket backpack assembly that can implement aspects of the described subject matter.

Referring now to FIGS. 3-4 with continuing reference to the foregoing figures, the jacket 12 can include a hood 62, a body covering portion 64, and a pair of sleeves 66-68. The wearer can insert the sleeves 66-68 into openings formed by the backpack 14 and the shoulder straps 38-40 when the jacket 12 is in an unfolded, wearable configuration. The straps 38-40 can be padded to enhance the comfort of the wearer when the jacket 12 is in the unfolded, wearable configuration. The jacket 12 can include a collar (not shown).

In general, the connector may be arranged in a predetermined geometric pattern, preferably a predetermined geometric pattern having at least one connected interface extending in a diagonal direction in relation to the vertical and horizontal directions of the jacket and backpack, more preferably having at least two connected interfaces extending in a diagonal direction in relation to the vertical and horizontal directions of the jacket and backpack. The predetermined geometric pattern preferably includes connected interfaces extending diagonally in a vertically downward and horizontally outward direction. As further described in various embodiments below, the center of the backpack front surface may include a diamond-shaped or triangular-shaped pattern to connect the jacket to the backpack.

As shown in FIGS. 3-4, the connector 16 is arranged in a predetermined geometric pattern, specifically a diamond shaped pattern, when viewed from the front. The connector 16 is formed by stitching the jacket 12 to the backpack 14 (or vice versa) in the diamond shaped pattern. The use of a permanent connection prevents the jacket 12 from being separated from the backpack 14 when it is stored at schools and/or daycare facilities. The use of a permanent connection also enhances durability and washability.

The connector 16 is arranged in a diamond shape and positioned at center portions 44-46 to enhance mobility when the jacket 12 is draped over a wearer. The dimensions of the diamond shape are not critical. Preferably, the width and the length of the diamond shape can be optimized to a predetermined cross section that is sufficiently large to enhance the stability of the backpack 14 when the jacket is draped over the wearer and the wearer is supporting the backpack 14.

The optimized dimensions of the diamond shape can enhance durability of the integral jacket backpack assembly 10 without sacrificing mobility of the wearer and, in particular, the mobility of the arms of the wearer of the jacket 12 when the wearer is supporting the backpack 14.

The jacket 12 can be any ordinary, commercially available or customized coat, raincoat, windbreaker, hoodie or any other style or type of jacket or coat that is suitable for children or adults. The jacket 12 can be of the poncho type with the hood 62 eliminating the need for the wearer to use a separate rainhat. The jacket 12 can be made from any suitable lightweight, heavy weight or intermediate weight material to form a softshell or hard shell outdoor and/or indoor coat. Exemplary embodiments include heavy hoodies made from wool material or other similar, thicker fabrics.

The jacket 12 can be made from thinner/lighter materials for use in the Spring season and/or in warmer climates and from thicker/heavier materials for use in the Fall/Winter seasons and/or in colder climates. The jacket 12 can be lined and/or insulated with one or more additional layers to provide additional protection in colder climates. The lining or insulation can be permanently attached or removably attached. When the jacket 12 is a raincoat, the jacket 12 can be made of synthetic plastic sheeting, such as polyethylene or polyester or of fabric sheeting having a plastic laminated thereto to render it waterproof.

The backpack 14 can be any ordinary, commercially available or customized backpack, knapsack or other similar pack. The backpack 14 can be configured in any shape that is suitable for children and/or adults. It is contemplated that the backpack 14 can be configured to display the logo of a sports team and/or configured in a streamlined manner to enhance participation in athletic events and/or outdoor sports.

The jacket 12 and the backpack 14 can be made from the same material or from different materials. The use of the same material for the jacket 12 and the backpack 14 can enhance washability of the integral jacket backpack assembly 10.

The integral jacket backpack assembly 10 can include the jacket 12 and the backpack 14 arranged in various configurations. The jacket 12 and the backpack 14 can be provided in varying sizes, depending upon the needs of the wearer. The integral jacket backpack assembly 10 can be offered "off the rack" in standard sizes and distributed through conventional "brick and mortar" or through e-commerce distribution channels. The integral jacket backpack assembly 10 can be offered can be provided "made to order" in custom applications that can be distributed in conventional or unconventional distribution channels.

Figure 5:
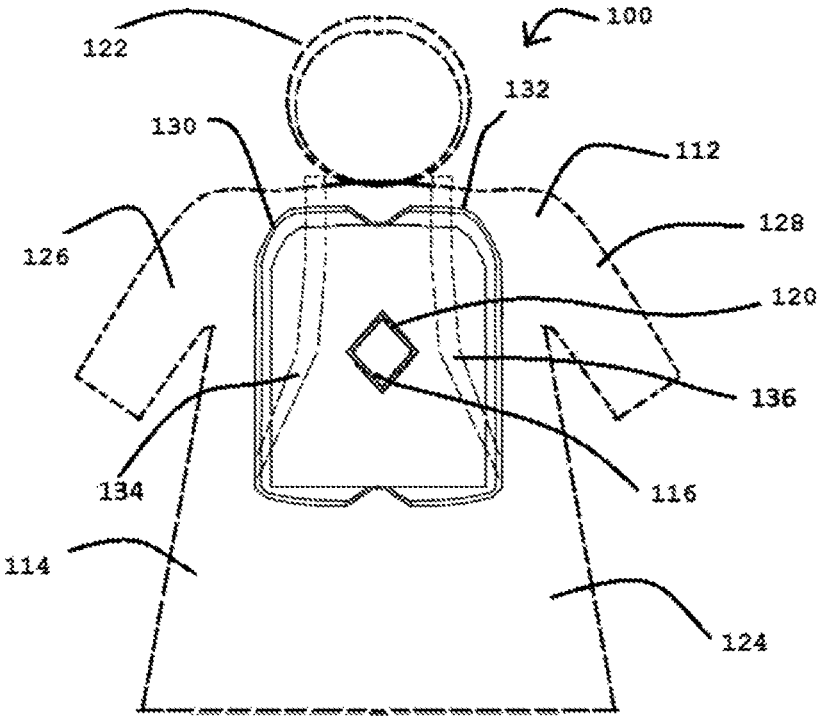
FIG. 5 illustrates a front view of another preferred embodiment of the integral jacket backpack assembly showing the jacket portion and shoulder straps in phantom that can implement aspects of the described subject matter.

Referring now to FIG. 5 with continuing reference to the foregoing figures, an integral jacket backpack assembly 100 is illustrated as an embodiment of an exemplary component of an integral jacket backpack assembly that may implement aspects of the described subject matter. Integral jacket backpack assembly 100 includes a jacket 112 (shown in phantom) and a backpack 114. The jacket 112 can be essentially identical to the jacket 12 shown in FIGS. 1-4. The backpack 114 can be essentially identical to the backpack 14 shown in FIGS. 1-4.

Unlike the embodiment shown in FIGS. 1-4, the integral jacket backpack assembly 100 connects the jacket 112 to the backpack 114 with a semi-permanent fastening mechanism 116. In this embodiment, the fastening mechanism 116 can be a rigid, essentially rigid, or semi-rigid connecting mechanism or locking device. In this exemplary embodiment, the fastening mechanism 116 is a zipper having a first interlocking portion 118 and a second interlocking portion 120.

The first interlocking portion 118 can be positioned on the jacket 112. The second interlocking portion 120 can be positioned on the backpack 114, so that the first interlocking portion 118 connects the second interlocking portion 120 when the integral jacket backpack assembly 100 is assembled. The first interlocking portion 118 and the second interlocking portion 120 can include teeth. Either the first interlocking portion 118 or the second interlocking portion 120 can include a clasp (not shown) to lock the zipper.

Integral jacket backpack assembly 100 utilizes fastening mechanism 116, which provides a semi-permanent connection between jacket 112 and backpack 114. The use of a semi-permanent connection provides less stability and durability, but can further enhance the washability of the jacket 112 and the backpack 114, as compared to the jacket 12 and the backpack 14.

As shown in FIG. 5, the jacket 112 is in an unfolded, wearable configuration with a hood 122, a body-covering portion 124 and two sleeves 126-128 unfolded to facilitate wearing. The jacket 112 illustrates the first interlocking portion 118 arranged in a diamond-shaped pattern. The second interlocking portion 120 is arranged in a diamond-shaped pattern on the backpack 114, so that fastening mechanism 116 has essentially the same geometry as connector 16.

The backpack 114 includes two side flaps 130-132 that have been disconnected and disengaged from one another to facilitate the unfolding of the jacket 112 into the unfolded, wearable configuration. The backpack 114 includes two spaced-apart shoulder straps 134-136 (shown in phantom). It should be understood that the embodiment shown in FIG. 5 is more suitable for older children and/or adults because the jacket 112 and the backpack 114 can be separated from one another and more easily lost.

Figure 6:
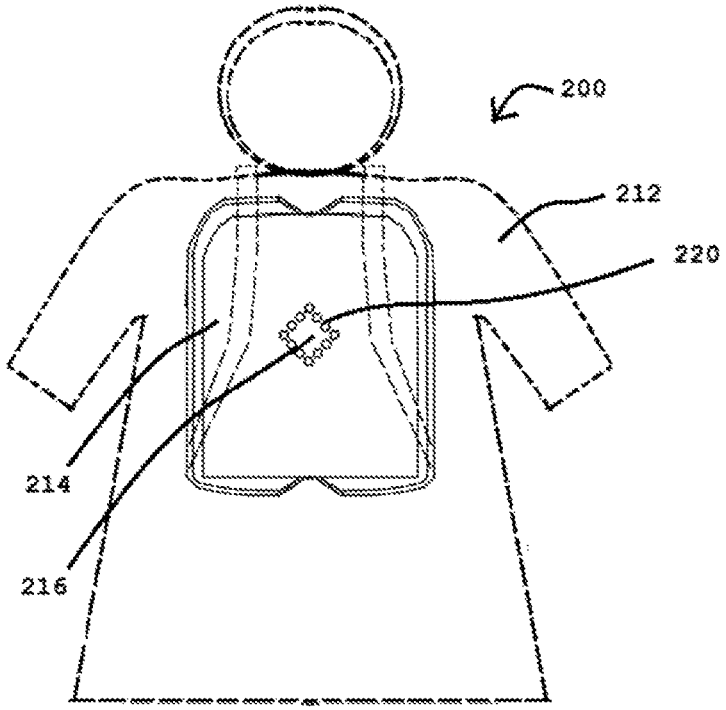
FIG. 6 illustrates a front view of a third preferred embodiment of the integral jacket backpack assembly showing the jacket portion and shoulder straps in phantom that can implement aspects of the described subject matter.

Referring now to FIG. 6 with continuing reference to the foregoing figures, an integral jacket backpack assembly 200 is illustrated as an embodiment of an exemplary component of an integral jacket backpack assembly that may implement aspects of the described subject matter. The integral jacket backpack assembly 200 includes a jacket 212 (shown in phantom) and a backpack 214. The jacket 212 can be essentially identical to the jacket 12 shown in FIGS. 1-4 and the jacket 112 shown in FIG. 5. The backpack 214 can be essentially identical to the backpack 14 shown in FIGS. 1-4 and the backpack 114 shown in FIG. 5.

The jacket 212 connects to the backpack 214 with a semi-permanent fastening mechanism 216. In this embodiment, the fastening mechanism 216 can be a rigid, essentially rigid, or semi-rigid connecting mechanism or locking device. In this exemplary embodiment, the fastening mechanism 216 can be snaps have a first interlocking portion 218 and a second interlocking portion 220. The first interlocking portion 218 can be positioned on the jacket 212. The second interlocking portion 220 can be positioned on the backpack 214, so that the first interlocking portion 218 connects the second interlocking portion 220 when the integral jacket backpack assembly 200 is assembled.

As shown in FIG. 6, the first interlocking portion 218 is arranged in a diamond-shaped pattern on the jacket 212. The second interlocking portion 220 is arranged in a diamond-shaped pattern on the backpack 214 to give the fastening mechanism 216 essentially the same geometry of the connector 16 and the fastening mechanism 116.

Figure 7:
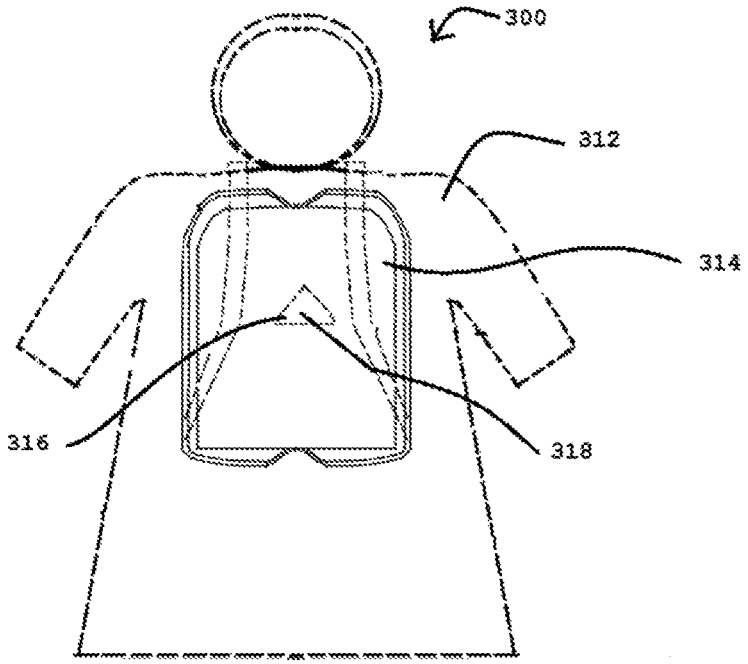
FIG. 7 illustrates a front view of a fourth preferred embodiment of the integral jacket backpack assembly showing the jacket portion and shoulder straps in phantom that can implement aspects of the described subject matter.

Referring now to FIG. 7 with continuing reference to the foregoing figures, an integral jacket backpack assembly 300 is illustrated as an embodiment of an exemplary component of an integral jacket backpack assembly that may implement aspects of the described subject matter.

The integral jacket backpack assembly 300 includes a jacket 312 (shown in phantom) and a backpack 314. The jacket 312 can be essentially identical to the jacket 12 shown in FIGS. 1-4, the jacket 112 shown in FIG. 5, and/or the jacket 212 shown in FIG. 6. The backpack 314 can be essentially identical to the backpack 14 shown in FIGS. 1-4, the backpack 114 shown in FIG. 5, and/or the backpack 214 shown in FIG. 6.

Unlike the embodiments shown in FIGS. 1-6, the jacket 312 connects to the backpack 314 with a permanent triangular shaped connector 316. While the shape/configuration of the connector 316 is different from the connector 16 shown in FIGS. 1-4, the connector 316 is otherwise identical to the connector 16 shown in FIGS. 1-4.

The connector 316 is formed by connecting center of a front surface of the backpack 314 to an outer surface of the jacket 312, which forms an essentially triangular cross section panel 318.

The dimensions of the triangular-shaped connector 316 are not critical. Preferably, the length of each side and the internal angles of the triangle shape is optimized to a predetermined cross section that is sufficiently large to enhance the stability of the backpack 314 when a jacket is draped over the wearer and the wearer is supporting the backpack 314.

The optimized dimensions of the connector 316 can enhance durability of the integral jacket backpack assembly 300 without sacrificing mobility of the wearer and, in particular, the mobility of the arms of the wearer of the jacket 312 when the wearer is supporting the backpack 314.

Figure 8:
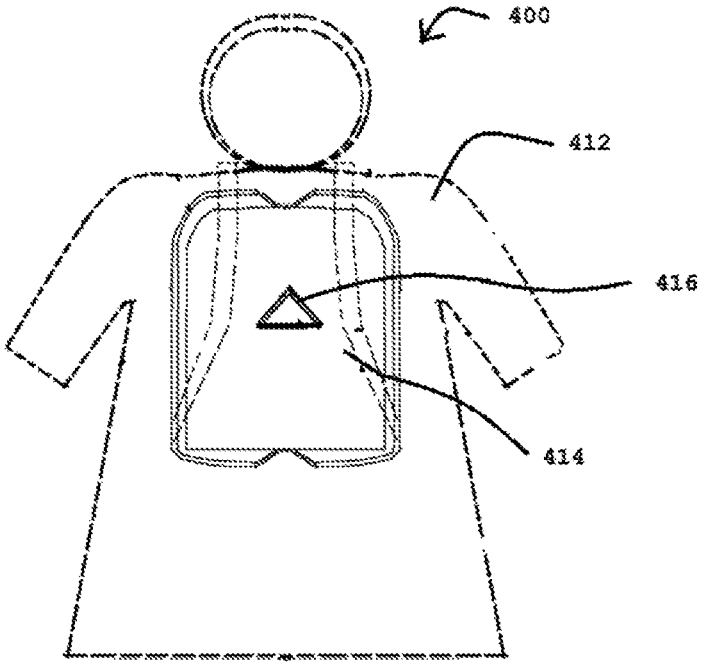
FIG. 8 illustrates a front view of a fifth preferred embodiment of the integral jacket backpack assembly showing the jacket portion and shoulder straps in phantom that can implement aspects of the described subject matter.

Referring now to FIG. 8 with continuing reference to the foregoing figures, an integral jacket backpack assembly 400 is illustrated as an embodiment of an exemplary component of an integral jacket backpack assembly that may implement aspects of the described subject matter.

The integral jacket backpack assembly 400 includes a jacket 412 (shown in phantom) and a backpack 414. The jacket 412 can be essentially identical to the jacket 12 shown in FIGS. 1-4, the jacket 112 shown in FIG. 5, the jacket 212 shown in FIG. 6 and/or the jacket 312 shown in FIG. 7. The backpack 414 can be essentially identical to the backpack 14 shown in FIGS. 1-4, the backpack 114 shown in FIG. 5, the backpack 214 shown in FIG. 6 and/or the backpack 314 shown in FIG. 7.

Unlike the embodiments shown in FIGS. 1-6, jacket 412 connects to the backpack 414 with a triangular fastening mechanism 416 that is otherwise identical to the fastening mechanism 116 shown in FIG. 5. The fastening mechanism 416 has essentially the same geometric arrangement or configuration as the connector 316 shown in FIG. 7.

Figure 9:
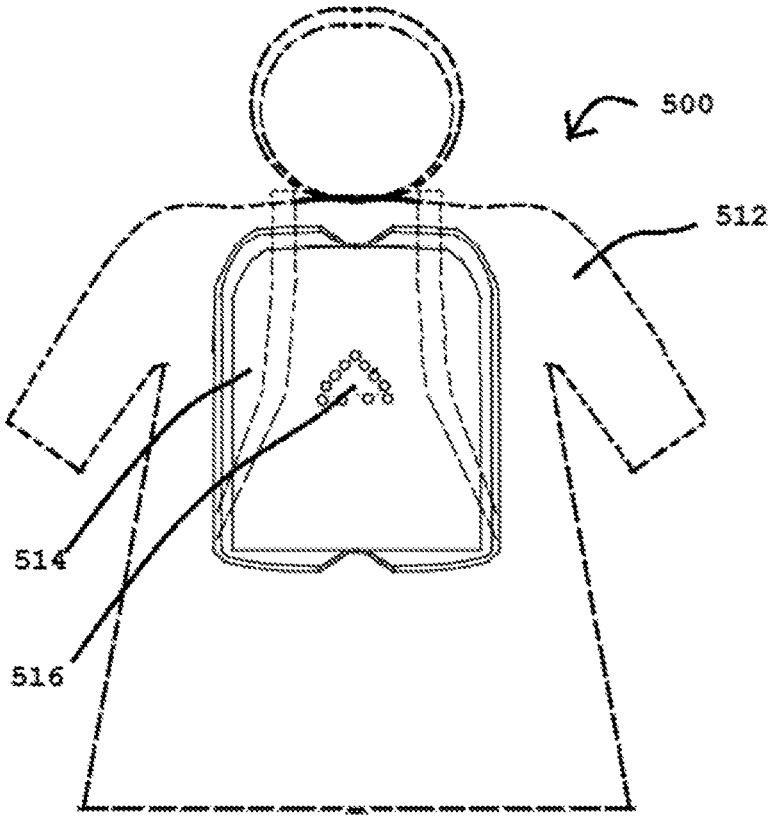
FIG. 9 illustrates a front view of a sixth preferred embodiment of the integral jacket backpack assembly showing the jacket portion and shoulder straps in phantom that can implement aspects of the described subject matter.

Referring now to FIG. 9 with continuing reference to the foregoing figures, an integral jacket backpack assembly 500 is illustrated as an embodiment of an exemplary component of an integral jacket backpack assembly that may implement aspects of the described subject matter.

The integral jacket backpack assembly 500 includes a jacket 512 (shown in phantom) and a backpack 514. The jacket 512 can be essentially identical to the jacket 12 shown in FIGS. 1-4, the jacket 112 shown in FIG. 5, the jacket 212 shown in FIG. 6, the jacket 312 shown in FIG. 7, and/or the jacket 412 shown in FIG. 8. The backpack 514 can be essentially identical to the backpack 14 shown in FIGS. 1-4, the backpack 114 shown in FIG. 5, the backpack 214 shown in FIG. 6, the backpack 314 shown in FIG. 7, and/or the backpack 414 shown in FIG. 8.

Unlike the embodiment shown in FIGS. 1-6, the jacket 512 connects to the backpack 514 with a triangular fastening mechanism 516 that is otherwise identical to the fastening mechanism 216 shown in FIG. 6. The fastening mechanism 516 has essentially the same geometric arrangement or configuration as the connector 316 shown in FIG. 7 and/or the fastening mechanism 416 shown in FIG. 8.

It is contemplated that hook-and-loop (i.e., Velcro® fasteners) can be used in a diamond-shaped pattern in place of the semi-permanent fastening mechanisms 116 and 216 shown in FIGS. 5-6 and/or the fastening mechanisms 416 and 516 shown in FIGS. 8-9. However, the fastening mechanisms 116, 216, 416, and 516 provide a more durable, secure connections than hook-and-loop fasteners. The fastening mechanisms 116, 216, 416, and 516 are more laundry-friendly, not prone to lint, and harder to remove, as compared to hook-and-loop fasteners.

Supported Aspects

The detailed description provided above in connection with the appended drawings explicitly describes and supports various aspects of a combined jacket and backpack in accordance with the described subject matter. By way of illustration and not limitation, supported aspects of the combined jacket and backpack include an integral jacket backpack assembly comprising: a jacket for draping over a wearer; the jacket having an outer surface with a front section covering the front of the wearer and back section covering the back of the wearer; and a backpack having a front surface and a back surface with the front surface abutting the jacket outer surface back section when the jacket is draped over a wearer; wherein the center of the backpack front surface connects to the center of the jacket outer surface back section to connect the jacket to the backpack permanently.

Supported aspects include the integral jacket backpack assembly described above, wherein the jacket permanently connects to the backpack with stitching.

Supported aspects include any of the integral jacket backpack assemblies described above, wherein a connector is arranged in a predetermined geometric pattern to connect the jacket to the backpack.

Supported aspects include any of the integral jacket backpack assemblies described above, wherein at least one connected interface extends in a diagonal direction in relation to the vertical and horizontal directions of the jacket and backpack to connect the jacket to the backpack.

Supported aspects include any of the integral jacket backpack assemblies described above, wherein at least two connected interfaces extend in a diagonal direction in relation to the vertical and horizontal directions of the jacket and backpack to connect the jacket to the backpack.

Supported aspects include any of the integral jacket backpack assemblies described above, wherein the predetermined geometric pattern includes connected interfaces extending diagonally in a vertically downward and horizontally outward direction.

Supported aspects include any of the integral jacket backpack assemblies described above, wherein the center of the backpack front surface includes a diamond-shaped or triangular-shaped pattern to connect the jacket to the backpack.

Supported aspects include any of the integral jacket backpack assemblies described above, wherein the center of the backpack front surface includes a diamond-shaped stitching pattern to connect the jacket to the backpack permanently.

Supported aspects include any of the integral jacket backpack assemblies described above, wherein the backpack includes a pouch for storing the jacket.

Supported aspects include any of the integral jacket backpack assemblies described above, which include a zipper for closing the pouch with the jacket stored therein.

Supported aspects include any of the integral jacket backpack assemblies described above, wherein the jacket is made of the same material as the backpack.

Supported aspects include any of the integral jacket backpack assemblies described above, wherein the center of the backpack front surface and the center of the jacket outer surface back are connected to form an essentially triangular cross section panel.

Supported aspects include any of the integral jacket backpack assemblies described above, wherein the jacket is selected from the group consisting of a raincoat, a windbreaker and a hoodie.

Supported aspects include any of the integral jacket backpack assemblies described above, which include a connector formed from a portion of the backpack front surface and a portion of the jacket outer surface back section.

Supported aspects include any of the integral jacket backpack assemblies described above, wherein the connector has a predetermined cross section to stabilize the backpack when the jacket is draped over a wearer.

Supported aspects include any of the integral jacket backpack assemblies described above, wherein the connector has a predetermined cross section that connects the backpack to the jacket without restricting the mobility of a wearer.

Supported aspects include an apparatus comprising: a jacket for draping over a wearer; the jacket having an outer surface with a front section covering the front of the wearer and back section covering the back of the wearer; a backpack having a front surface and a back surface with the front surface abutting the jacket outer surface back section to form an interface when the jacket is draped over a wearer; and a connecting mechanism for connecting the jacket to the backpack; wherein the connecting mechanism is essentially positioned at the center of the interface.

Supported aspects include the apparatus set forth above, wherein the connecting mechanism has a first interlocking portion on the jacket outer surface back section and a second interlocking portion on the backpack back surface with the first interlocking portion connecting to the second interlocking portion; and wherein the first interlocking portion is arranged in a diamond-shaped pattern on the jacket outer surface back section and the second interlocking portion arranged in a diamond-shaped pattern on the backpack back surface.

Supported aspects include any of the apparatuses set forth above, wherein the connecting mechanism has a predetermined cross section that connects the backpack to the jacket without restricting the mobility of a wearer.

Supported aspects include any of the apparatuses set forth above, wherein the backpack includes a pouch for storing the jacket.

Supported aspects include any of the apparatuses set forth above, which include a zipper for closing the pouch with the jacket stored therein.

Supported aspects include any of the apparatuses set forth above, wherein the jacket is made of the same material as the backpack.

Supported aspects include any of the apparatuses set forth above, wherein the jacket is selected from the group consisting of a raincoat, a windbreaker and a hoodie.

Supported aspects include an apparatus comprising: jacket means for covering a wearer; backpack means for storing items; and connecting means for connecting jacket means to backpack means.

Supported aspects include the apparatus set forth above, further comprising: means for connecting jacket means to backpack means permanently.

Supported aspects include any of the apparatuses set forth above, wherein backpack means stores jacket means.

Supported aspects include an integral jacket backpack assembly comprising: a jacket for draping over a wearer; the jacket having an outer surface with a front section covering the front of the wearer and back section covering the back of the wearer; a backpack having a front surface and a back surface with the front surface abutting the jacket outer surface back section when the jacket is draped over a wearer; and a semi-permanent fastening mechanism for connecting the jacket to the backpack having a first interlocking portion on the jacket outer surface back section and a second interlocking portion on the backpack back surface with the first interlocking portion connecting to the second interlocking portion; wherein the first interlocking portion arranged in a diamond-shaped pattern on the jacket outer surface back section and the second interlocking portion arranged in a diamond-shaped pattern on the backpack back surface.

Supported aspects include the integral jacket backpack assembly described above, wherein the semi-permanent fastening mechanism includes snaps.

Supported aspects include any of the integral jacket backpack assemblies described above, wherein the semi-permanent fastening mechanism includes a zipper.

Supported aspects include any of the integral jacket backpack assemblies described above, wherein the backpack includes a porous pouch for storing the jacket.

Supported aspects include any of the integral jacket backpack assemblies described above, which include a zipper for closing the porous pouch with the jacket stored therein.

Supported aspects include any of the integral jacket backpack assemblies described above, wherein the jacket is made of the same material as the backpack.

Supported aspects include any of the integral jacket backpack assemblies described above, wherein the jacket is selected from the group consisting of a raincoat, a windbreaker and a hoodie.

Supported aspects include an integral jacket backpack assembly comprising: a jacket for draping over a wearer; the jacket having an outer surface with a front section covering the front of the wearer and back section covering the back of the wearer; and a backpack having a front surface and a back surface with the front surface abutting the jacket outer surface back section when the jacket is draped over a wearer; means for connecting the jacket to the backpack.

Supported aspects include the integral jacket backpack assemblies described above, further comprising means for connecting the jacket to the backpack permanently.

Supported aspects include any of the integral jacket backpack assemblies described above, further comprising: means for storing the jacket.

Supported aspects can provide various attendant and/or technical advantages in terms of improved efficiency and/or savings with respect to materials, durability, wearability, mobility, and washability. By way of illustration and not limitation, various features and implementations in accordance with the described subject matter utilize a permanent connection between a jacket and a backpack that is optimally placed to ensure that the backpack is secured to the jacket when the jacket is draped over a wearer. The connection allows the wearer to wear the backpack without sacrificing mobility.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. An integral jacket backpack assembly comprising:

a jacket for draping over a wearer;

the jacket having an outer surface with a front section covering the front of the wearer and back section covering the back of the wearer; and a backpack having a front surface and a back surface with the front surface abutting the jacket outer surface back section when the jacket is draped over a wearer;

wherein the center of the backpack front surface includes a predetermined stitching pattern selected from the group consisting of diamond-shaped stitching patterns and triangular-shaped stitching patterns that form an interface connecting the center of the jacket outer surface back section to the backpack; and wherein the length and the width of the interface has a predetermined cross section that is sufficiently large to enhance the stability of the backpack when the jacket is draped over the wearer and the wearer is supporting the backpack.

2. The integral jacket backpack assembly set forth in claim 1, wherein the jacket permanently connects to the backpack with stitching.

3. The integral jacket backpack assembly set forth in claim 1, wherein the backpack includes a pouch for storing the jacket.

4. The integral jacket backpack assembly set forth in claim 3, which includes a zipper for closing the pouch with the jacket stored therein.

5. The integral jacket backpack assembly set forth in claim 1, wherein the jacket is selected from the group consisting of a raincoat, a windbreaker and a hoodie.

6. The integral jacket backpack assembly set forth in claim 1, which includes:

a connector formed from a portion of the backpack front surface and a portion of the jacket outer surface back section; and the connector essentially has the same predetermined cross section as the interface.

7. The integral jacket backpack assembly set forth in claim 6, wherein the length and the width of the interface is sufficiently small that the connector does not restrict the mobility of a wearer.

8. The integral jacket backpack assembly set forth in claim 1, wherein the jacket is made of the same material as the backpack.

9. An apparatus comprising:

a jacket for draping over a wearer;

the jacket having an outer surface with a front section covering the front of the wearer and a back section covering the back of the wearer;

a backpack having a front surface and a back surface with the front surface abutting the jacket outer surface back section to form an interface when the jacket is draped over a wearer; and a connecting mechanism for connecting the jacket to the backpack;

wherein the connecting mechanism is essentially positioned at the center of the interface;

wherein the connecting mechanism includes a predetermined stitching pattern selected from the group consisting of diamond-shaped stitching patterns and triangular-shaped stitching patterns that form the interface; and wherein the length and the width of the predetermined stitching pattern have a predetermined cross section that is sufficiently large so that the connecting mechanism enhances the stability of the backpack when the jacket is draped over the wearer and the wearer is supporting the backpack.

10. The apparatus set forth in claim 9, wherein the connecting mechanism has a first interlocking portion on the jacket outer surface back section and a second interlocking portion on the backpack back surface with the first interlocking portion connecting to the second interlocking portion.

11. The apparatus set forth in claim 10, wherein the connecting mechanism has a predetermined cross section that connects the backpack to the jacket without restricting the mobility of a wearer.

12. The apparatus set forth in claim 9, wherein the backpack includes a porous pouch for storing the jacket.

13. The apparatus set forth in claim 12, which includes a zipper for closing the porous pouch with the jacket stored therein.

14. The apparatus set forth in claim 9, wherein the jacket is made of the same material as the backpack.

15. The apparatus set forth in claim 9, wherein the jacket is selected from the group consisting of a raincoat, a windbreaker and a hoodie.

16. An apparatus comprising:

jacket means for covering a wearer;

backpack means for storing items; and connecting means for connecting jacket means to backpack means;

wherein the connecting means includes a predetermined stitching pattern selected from the group consisting of diamond-shaped stitching patterns and triangular-shaped stitching patterns that form an interface connecting the jacket to the backpack; and wherein the length and the width of the interface are sufficiently large so that the connecting means enhances the stability of the backpack when the jacket is draped over the wearer and the wearer is supporting the backpack.

17. The apparatus set forth in claim 16, further comprising:

means for connecting jacket means to backpack means permanently.

18. The apparatus set forth in claim 16, wherein backpack means stores jacket means.

19. The apparatus set forth in claim 16, wherein length and the width of the interface is sufficiently small that the connector does not restrict the mobility of a wearer.

20. The apparatus set forth in claim 16, wherein the jacket is made of the same material as the backpack.

* * * * *